US011312587B2

(12) United States Patent
Doyo

(10) Patent No.: US 11,312,587 B2
(45) Date of Patent: Apr. 26, 2022

(54) SHEET FEEDING DEVICE AND IMAGE FORMING APPARATUS

(71) Applicant: KYOCERA Document Solutions Inc., Osaka (JP)

(72) Inventor: Hideaki Doyo, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 106 days.

(21) Appl. No.: 16/854,714

(22) Filed: Apr. 21, 2020

(65) Prior Publication Data

US 2020/0331717 A1 Oct. 22, 2020

(30) Foreign Application Priority Data

Apr. 22, 2019 (JP) ..... JP2019-080830

(51) Int. Cl.
*B65H 3/06* (2006.01)
*B65H 5/06* (2006.01)

(52) U.S. Cl.
CPC ..... *B65H 3/0607* (2013.01); *B65H 5/062* (2013.01)

(58) Field of Classification Search
CPC ..... B65H 3/0607; B65H 3/0669; B65H 3/06
See application file for complete search history.

(56) References Cited

U.S. PATENT DOCUMENTS 4,316,606 A * 2/1982 Buys ..... B65H 3/5261 271/10.04
5,435,537 A * 7/1995 Gysling ..... B65H 3/0669 271/10.05
5,472,183 A * 12/1995 Kubo ..... B65H 1/08 271/110
5,474,287 A * 12/1995 Takahashi ..... B65H 3/5261 271/10.11
7,950,649 B2 * 5/2011 Katsura ..... B65H 1/04 271/10.03
2005/0082739 A1 * 4/2005 Mitsuya ..... B65H 3/0653 271/10.11
2014/0239575 A1 * 8/2014 Hasegawa ..... B65H 29/54 271/125
2017/0210582 A1 * 7/2017 Okano ..... B65H 5/062

FOREIGN PATENT DOCUMENTS

JP 5-97262 * 4/1993
JP 2001-294335 A 10/2001

* cited by examiner

*Primary Examiner* — Thomas A Morrison
(74) *Attorney, Agent, or Firm* — Studebaker & Brackett PC

(57) ABSTRACT

A sheet feeding device includes a pickup roller, a feed roller, a retard roller, a conveyance rollers pair. The pickup roller contacts a sheet at a first contact point in a pickup position and rotates to convey the sheet in a predetermined conveyance direction. The feed roller is disposed on a downstream side of the pickup roller in the conveyance direction. The retard roller contacts the feed roller at a second contact point and conveys the sheet while separating the sheet. The conveyance rollers pair contacts each other at a third contact point and conveys the sheet passing through the second contact point to a conveyance path. The first contact point, the second contact point and the third contact point are disposed on a linear line in the conveyance direction, when viewed from axial directions of the rollers.

5 Claims, 11 Drawing Sheets

SHEET FEEDING DEVICE AND IMAGE FORMING APPARATUS

INCORPORATION BY REFERENCE

This application is based on and claims the benefit of priority from Japanese patent application No. 2019-080830 filed on Apr. 22, 2019, which is incorporated by reference in its entirety.

BACKGROUND

The present disclosure relates to a sheet feeding device which feeds a sheet and an image forming apparatus including the sheet feeding device.

The sheet feeding device is conventionally provided with a pickup roller which conveys a sheet from a sheet feeding cassette, a feed roller disposed on a downstream side of the pickup roller in the conveyance direction, and a retard roller which comes into contact with the feed roller to form a separation nip and conveys the sheet while separating the sheet at the separation nip.

By the way, the sheet conveyed by the sheet feeding device is conveyed to an image forming part along a conveyance path. On the conveyance path, conveyance rollers are provided to convey the sheet along the conveyance path. Depending on a layout of the sheet feeding device and the image forming part, the conveyance path may not be formed along the conveyance direction of the sheet conveyed from the feeding device. For example, the conveyance path may be formed so as to curve at approximately right angles to the conveyance direction.

In such a case, because the separation nip and a conveyance nip between the conveyance rollers are not aligned on a linear line, when the sheet is nipped at both the nips, the feed roller or the retard roller is applied with load from the sheet. Then, the feed roller or the retard roller may wear owing to the friction with the sheet. At the separation nip, the sheet is separated based on a difference of friction force between the feed roller and the sheet and friction force between the retard roller and the sheet. Thereby, if the rollers may wear, the above difference of friction forces may be hardly generated, and conveyance failure, such as non-sheet feeding and multiple sheet feeding, easily occurs. Especially, in a case of a poor quality sheet, the feed roller or the retard roller easily wears, and the life of each roller is shortened.

SUMMARY

In accordance with an aspect of the present disclosure, a sheet feeding device includes a pickup roller, a feed roller, a retard roller, a conveyance rollers pair. The pickup roller contacts a sheet at a first contact point in a pickup position and rotates to convey the sheet in a predetermined conveyance direction. The feed roller is disposed on a downstream side of the pickup roller in the conveyance direction. The retard roller contacts the feed roller at a second contact point and conveys the sheet while separating the sheet. The conveyance rollers pair contacts each other at a third contact point and conveys the sheet passing through the second contact point to a conveyance path. The first contact point, the second contact point and the third contact point are disposed on a linear line in the conveyance direction, when viewed from axial directions of the rollers.

In accordance with an aspect of the present disclosure, an image forming apparatus includes an apparatus main body, an image forming part, an upstream side cassette, a downstream side cassette and a horizontal sheet feeding mechanism. In the apparatus main body, the conveyance path is formed. The image forming part is disposed on the conveyance path and forms an image on the sheet. The upstream side cassette is disposed below the image forming part and accommodates the sheet. The downstream side cassette is disposed on a downstream side in a horizontal conveyance direction of the upstream side cassette side by side. The downstream side cassette accommodates the sheet. The horizontal sheet feeding mechanism conveys the sheet from the upstream side cassette and the downstream side cassette to the conveyance path. The horizontal sheet feeding mechanism includes a horizontal conveyance path and the two sheet feeding devices. The horizontal conveyance path is disposed above the upstream side cassette and the downstream side cassette and connects to the conveyance path. The sheet accommodated in the upstream side cassette is conveyed along the horizontal conveyance path. One of the two sheet feeding devices conveys the sheet from the upstream side cassette to the horizontal conveyance path. The other of the two sheet feeding devices conveys the sheet from the downstream side cassette (13L2) to the conveyance path.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, an image forming apparatus and a sheet feeding device according to one embodiment of the present invention will be described with reference to the drawings.

Figure 1:
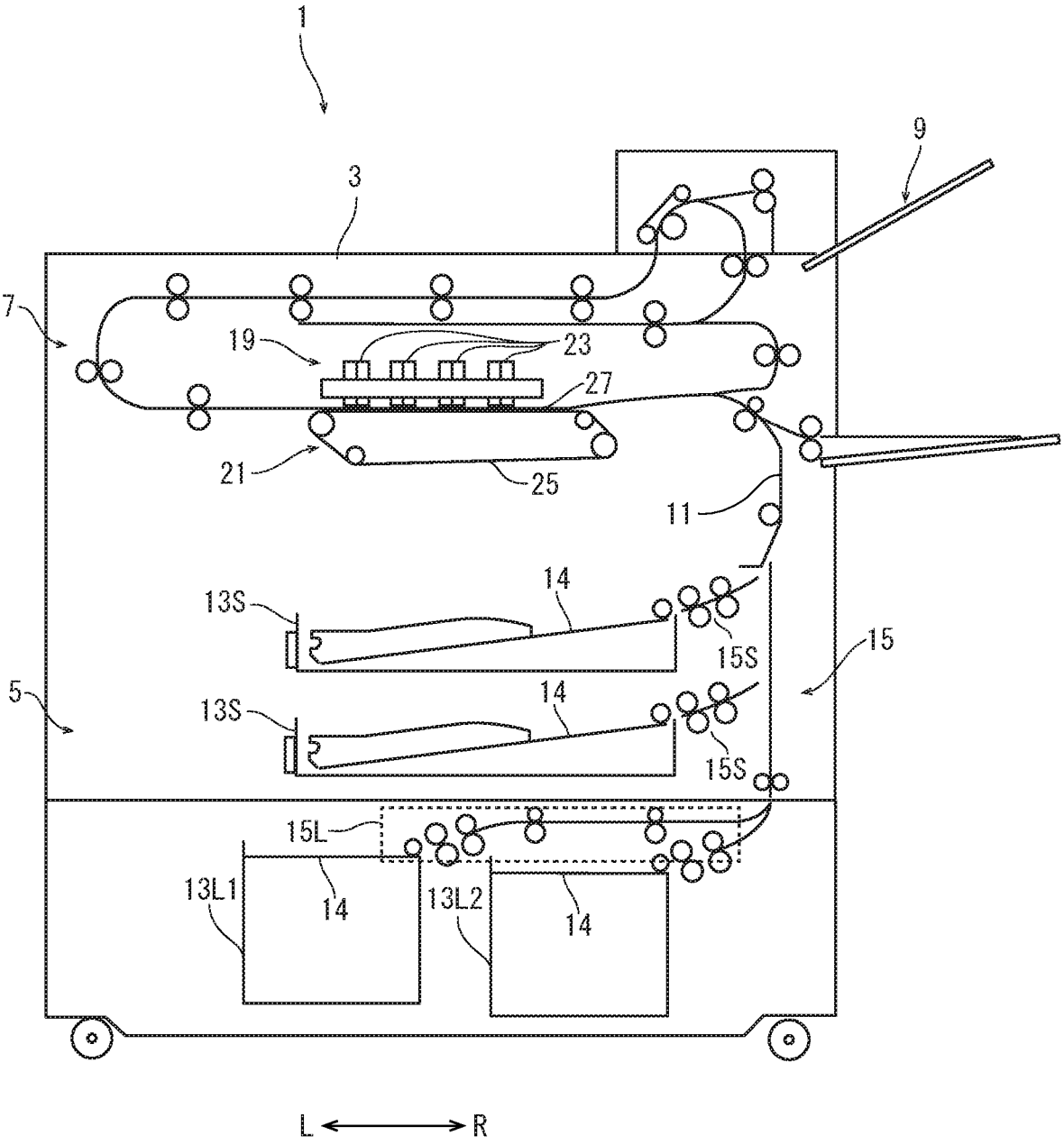
FIG. 1 is a front view schematically showing an inner structure of an image forming apparatus according to one embodiment of the present disclosure.

With reference to FIG. 1, an image forming apparatus 1 will be described. FIG. 1 is a front view schematically showing an inner structure of the image forming apparatus 1 (at the image forming processing). In the following description, a front side (a near side) on a paper surface in FIG. 1 is defined as a front side of the image forming apparatus 1. In each figure, Fr, Rr, L and R respectively show a front side, a rear side, a left side and a right side of the image forming apparatus 1.

An apparatus main body 3 of the image forming apparatus 1 includes a sheet feeding part 5 and an inkjet type image forming part 7. In the apparatus main body 3, a conveyance path 11 is formed from the sheet feeding part 5 through the image forming part 7 to a discharge tray 9.

The sheet feeding part 5 is provided in the lower portion of the apparatus main body 3, and includes sheet feeding cassettes accommodating sheets and a sheet feeding mechanism 15 conveying the sheet from the respective sheet feeding cassettes.

The sheet feeding cassettes contain two large capacity cassettes 13L1 and 13L2 (an upstream side cassette and a downstream side cassette) and two small capacity cassettes 13S. The two large capacity cassettes 13L1 and 13L2 accommodate a first sheet and a second sheet respectively, and are disposed side by side in the left-and-right direction. The two small capacity cassettes 13S are disposed adjacently in the upper-and-lower direction above the two large capacity cassettes 13L1 and 13L2. In each cassette, a sheet placement plate 14 on which the sheet is placed is supported in a movable manner in the upper-and-lower direction by a lifting mechanism (not shown). The sheet placement plate 14 has a slit (not shown) through which an actuator provided in a sheet feeding device 37 described later is passable.

The sheet feeding mechanism 15 contains a horizontal sheet feeding mechanism 15L which conveys the first and second sheets from the two large capacity cassettes 13L1 and 13L2 and an individual sheet feeding mechanism 15S which conveys the sheet from each of the small capacity cassette 13S. The horizontal sheet feeding mechanism 15L and the individual sheet feeding mechanisms 15S convey the sheet fed from the respective cassettes to the conveyance path 11. On the conveyance path 11, conveyance rollers are provided at predetermined intervals to convey the sheet to the image forming part 7 along the conveyance path 11.

The image forming part 7 is provided in the upper portion of the apparatus main body 3, and includes a head unit 19 and a conveyance unit 21. The head unit 19 includes four line heads 23. The four line heads 23 are disposed side by side in the left-and-right direction, and connected to the respective ink tanks (not shown) storing the respective inks. The conveyance unit 21 includes a circulating conveyance belt 25. The conveyance belt 25 is disposed below the four line heads 23 at a predetermined gap. A region between the four line heads 23 and the conveyance belt 25 forms an image forming path 27.

When an image forming job is input to the image forming apparatus 1, the sheet of an indicated size is conveyed to the conveyance path 11 from the corresponding cassette by the corresponding sheet feeding mechanism 15, and then to the image forming path 27 of the image forming part 7. On the image forming path 27, the inks are ejected from the line heads 23 based on the image data, and an image is formed on the sheet. The sheet having the image is conveyed along the conveyance path 11 by the conveyance rollers, and then discharged on the discharge tray 9.

Figure 2:
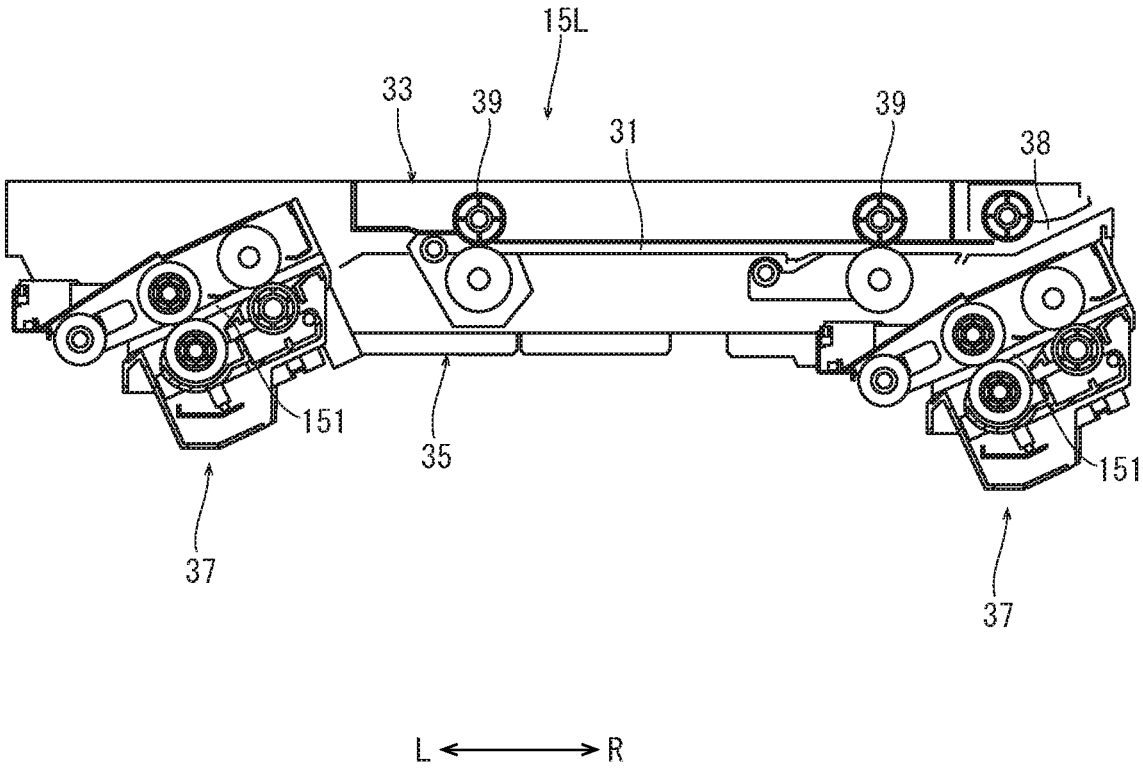
FIG. 2 is a front view showing a horizonal sheet feeding mechanism of the image forming apparatus according to the embodiment of the present disclosure.

Next, the horizontal sheet feeding mechanism 15L will be described with reference to FIG. 2. FIG. 2 is a front view showing the horizontal sheet feeding mechanism.

The horizontal sheet feeding mechanism 15L includes an upper guide plate 33, a lower guide plate 35 and two sheet feeding devices 37. Between the upper guide plate 33 and the lower guide plate 35, a horizontal conveyance path 31 is formed, which is communicated with the conveyance path 11. The left sheet feeding device 37 conveys the sheet from the left large capacity cassette 13L1 (the upstream side cassette) and the right sheet feeding device 37 conveys the sheet from the right large capacity cassette 13L2 (the downstream side cassette). The horizontal sheet feeding mechanism 15L is attached to the apparatus main body 3 in a detachable manner along the front-and-rear direction.

The upper guide plate 33 is supported by a fulcrum provided in the rear end portion of the lower guide plate 35 in a turnable manner. When the upper guide plate 33 is turned downward, the horizontal conveyance path 31 is formed between both the guide plates 33 and 35 along the conveyance direction from the left side to the right side. The downstream end of the horizontal conveyance path 31 is connected to an inclined path 38 communicated with the conveyance path 11. When the upper guide plate 33 is turned upward, the horizontal conveyance path 31 is opened so as to treat paper gamming occurred in the horizontal conveyance path 31.

On the horizontal conveyance path 31, two sets of conveyance rollers pair 39 are provided at the upstream portion and at the downstream portion in the conveyance direction. The conveyance rollers pair 39 of each set contain a lower roller driven by a driving source to be rotated and an upper roller driven by the lower roller to be rotated. The lower rollers are supported by the lower guide plate 35 in a rotatable manner, and the upper rollers are supported by the upper guide plate 33 in rotatable manner.

The left sheet feeding device 37 is disposed at the upstream side end of the horizontal conveyance path 31, and conveys the first sheet to the horizontal conveyance path 31 from the upstream side cassette 13L1. The right sheet feeding device 37 is disposed below the inclined path 38, and conveys the second sheet to the conveyance path 11 from the downstream side cassette 13L2. The left and right sheet feeding devices 37 have the same structure.

The individual sheet feeding mechanism 15S includes the sheet feeding device 37 having the same structure as the left and right sheet feeding devices 37. The sheet feeding device 37 (the individual sheet feeding mechanism 15S) is attached to the apparatus main body 3 in a detachable manner along the front-and-rear direction.

Figure 3:
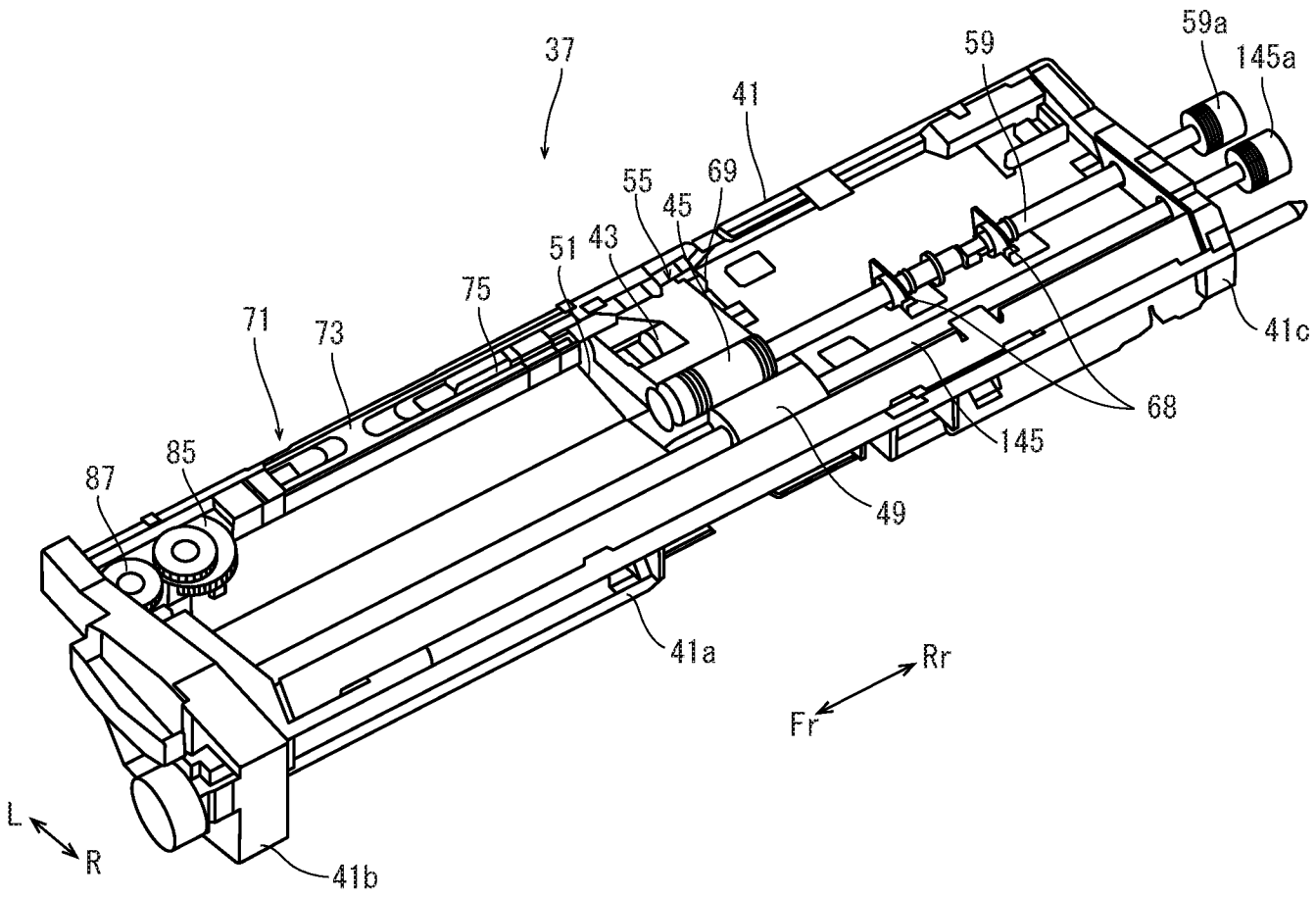
FIG. 3 is a perspective view showing a sheet feeding device according to the embodiment of the present disclosure.
Figure 4:
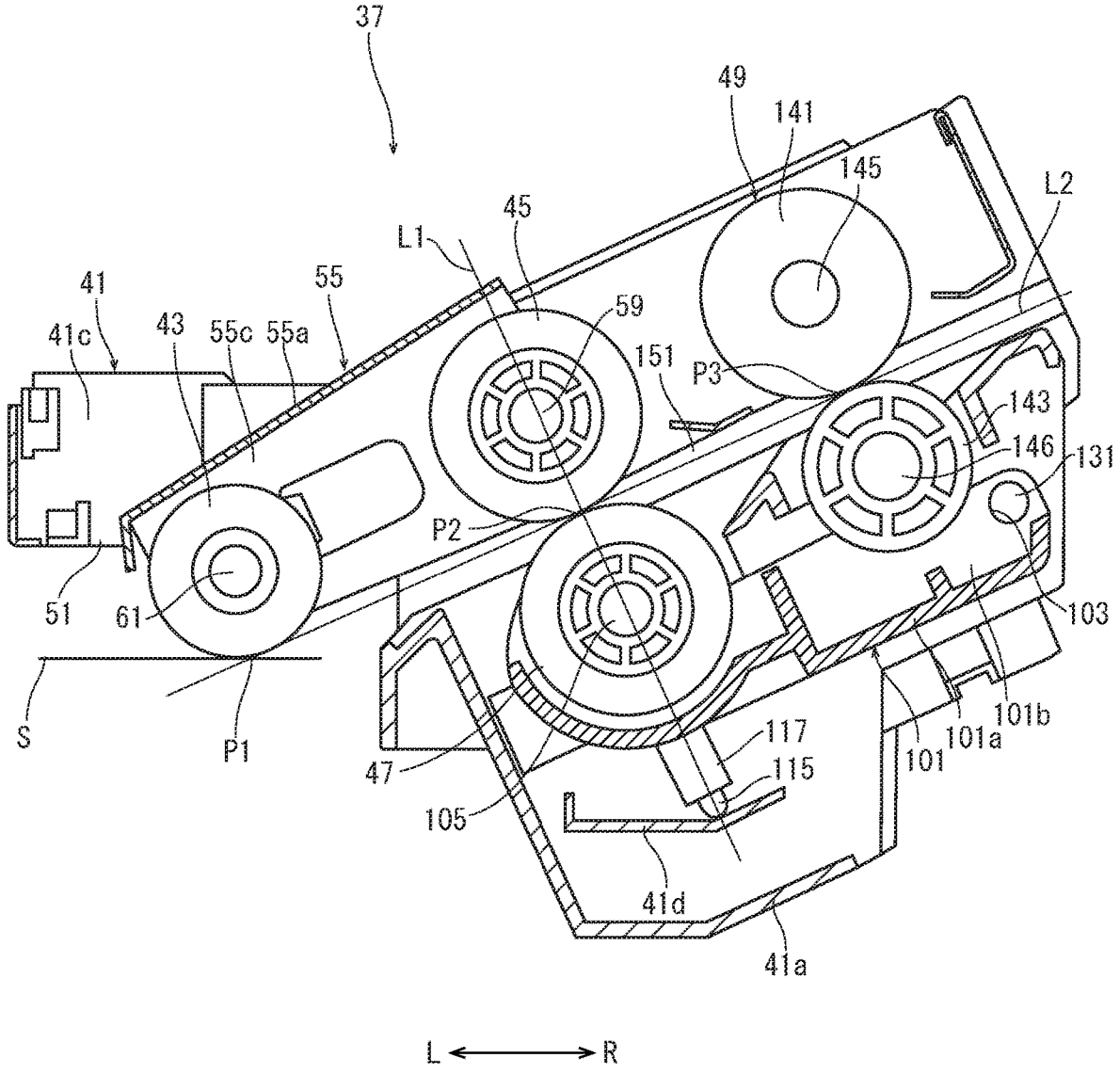
FIG. 4 is a sectional view showing the sheet feeding device (in a state where a pickup roller is in a pickup position) according to the embodiment of the present disclosure.

Next, the sheet feeding device 37 will be described with reference to FIG. 3 and FIG. 4. FIG. 3 is a perspective view showing the sheet feeding device 37 and FIG. 4 is a sectional view showing the sheet feeding device 37.

The sheet feeding device 37 includes a pickup roller 43, a feed roller 45, a retard roller 47 (refer to FIG. 4, not shown in FIG. 3) and a conveyance rollers pair 49. The pickup roller 43, the feed roller 45, the retard roller 47 (refer to FIG.

4, not shown in FIG. 3) and the conveyance rollers pair 49 are integrated into one unit and provided in a single housing 41.

The housing 41 has a bottom plate 41*a*, and a front and rear side plates 41*b* and 41*c*. The bottom plate 41*a* has an approximately rectangular shape long in a width direction (the front-and-rear direction) perpendicular to the conveyance direction. The front and rear side plates 41*b* and 41*c* face each other in the width direction. The bottom plate 41*a* has an opening 51 in the center portion in the width direction. The bottom plate 41*a* is provided with an actuator (not shown) protruding downward from near the opening 51 in a turnable manner. The actuator is for detecting presence of the sheet placed on the sheet placement plate 14 (refer to FIG. 1) of the large capacity cassette 13L. When the sheet is placed on the sheet placement plate 14, the actuator comes into contact with the sheet to be turned in a predetermined posture. When there is no sheet placed on the sheet placement plate 14, the actuator turns downward through the slit from the predetermined posture. On the other hand, the apparatus main body 3 is provided with a PE sensor (not shown) to detect the actuator. The PE sensor is an optical sensor having a light emitting part emitting light and a light receiving part receiving the emitted light. The PE sensor outputs an OFF signal when the actuator turns in the predetermined posture, and outputs an ON signal when the actuator turns from the predetermined posture.

Figure 5:
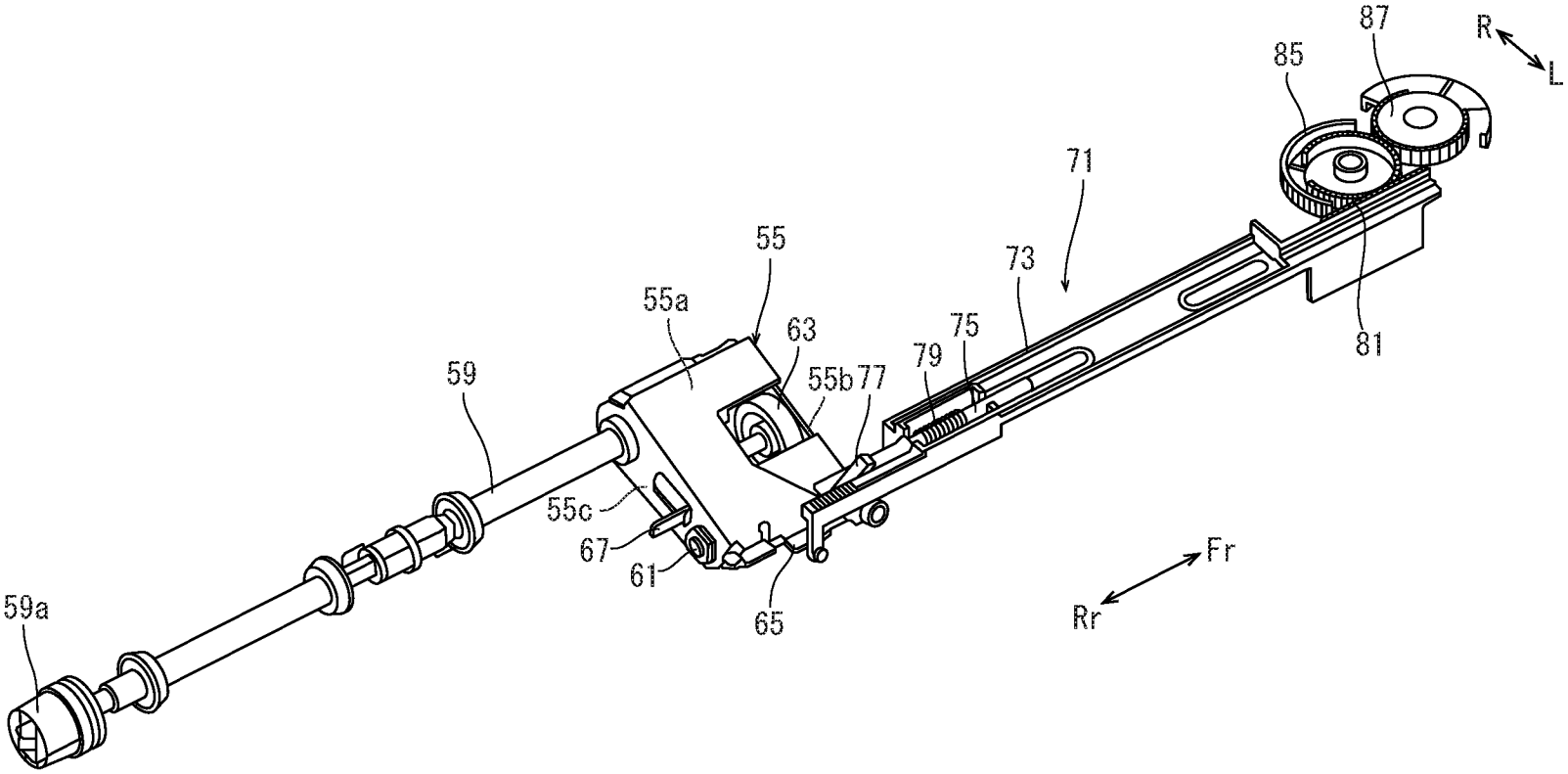
FIG. 5 is a perspective view showing a sheet feeding holder and a pressing force adjustment mechanism, in the sheet feeding device according to the embodiment of the present disclosure.
Figure 6:
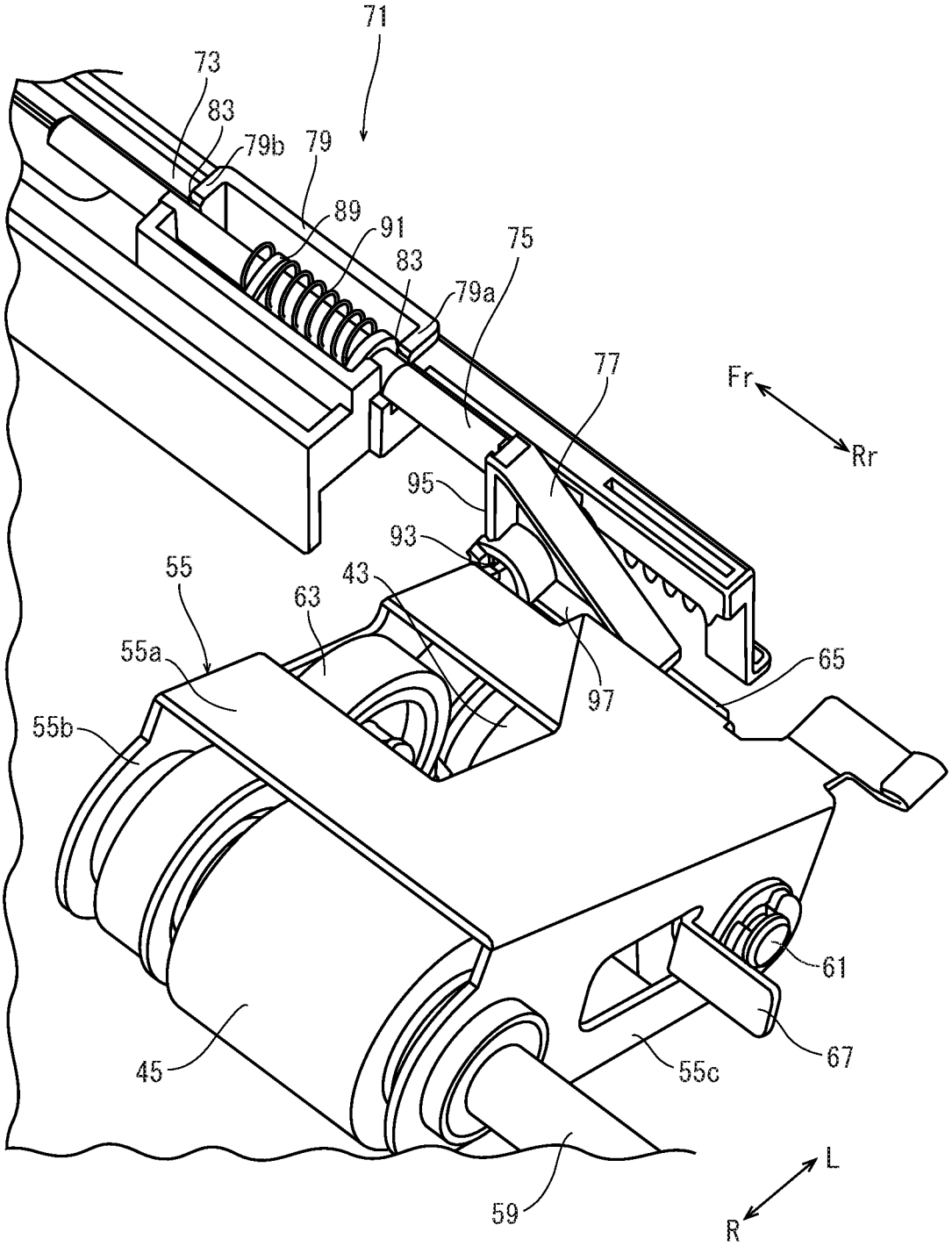
FIG. 6 is a perspective view showing the sheet feeding holder and the pressing force adjustment mechanism, when viewed from the upper side, in the sheet feeding device according to the embodiment of the present disclosure.
Figure 7:
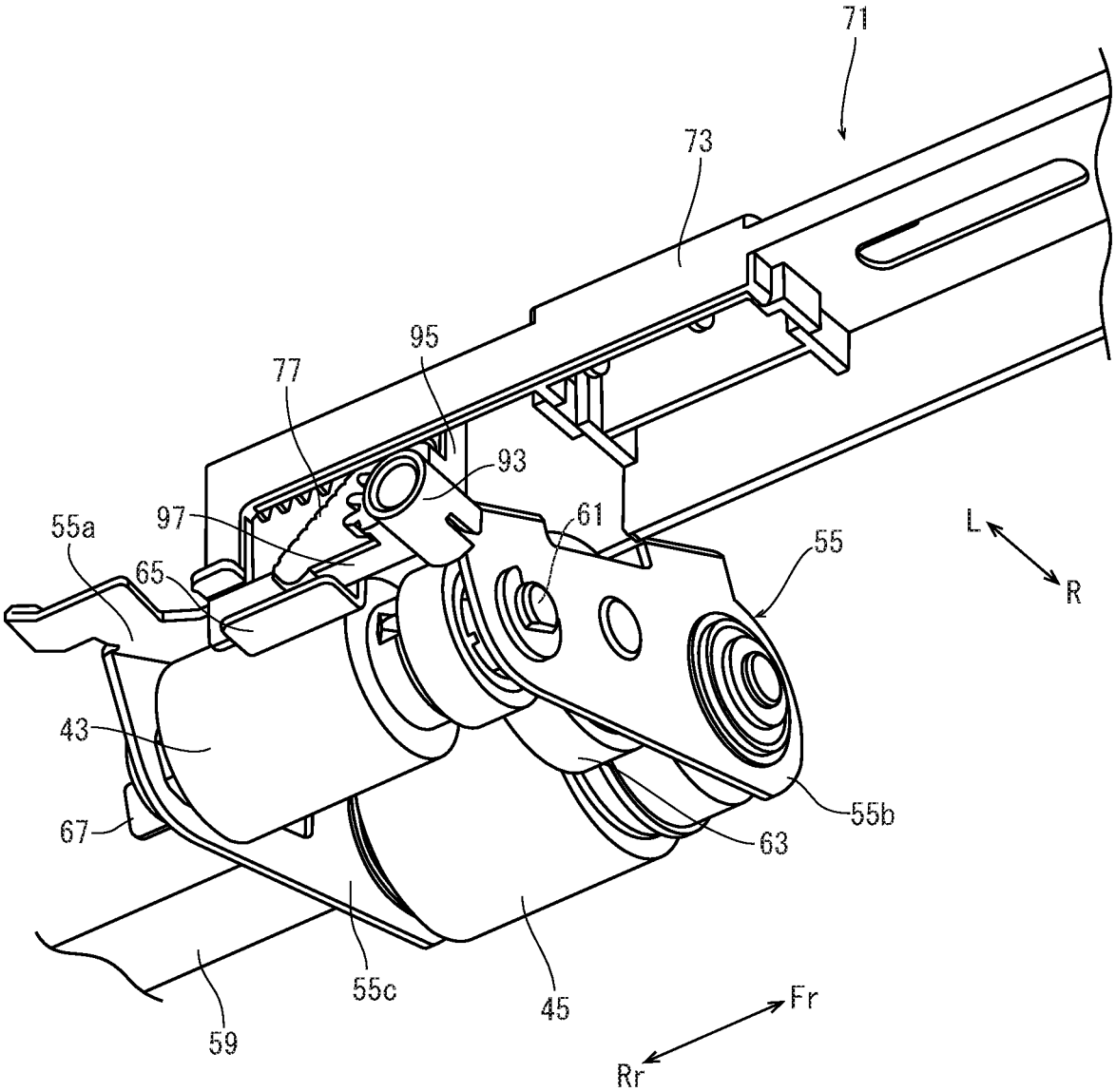
FIG. 7 is a perspective view showing the sheet feeding holder and the pressing force adjustment mechanism, when viewed from the lower side, in the sheet feeding device according to the embodiment of the present disclosure.

The pickup roller 43 and the feed roller 45 are supported by a sheet feeding holder 55. With reference to FIG. 5 to FIG. 7, in addition to FIG. 3 and FIG. 4, the pickup roller 43, the feed roller 4 and the sheet feeding holder 55 will be described. FIG. 5 is a perspective view showing the sheet feeding holder and a pressing force adjustment mechanism, FIG. 6 is a perspective view showing the sheet feeding holder and the pressing force adjustment mechanism, when viewed from the upper side, and FIG. 7 is a perspective view showing the sheet feeding holder and the pressing force adjustment mechanism, when viewed from the lower side.

The sheet feeding holder 55 is an approximately parallelepiped box-like member whose lower face is opened, and has a top plate 55*a*, and a front side plate 55*b* and a rear side plate 55*c* facing each other in the width direction. The sheet feeding holder 55 is supported by a driving shaft 59 of the feed roller 45, described later, in a turnable manner. In detail, the driving shaft 59 is provided between the one end portions (the right end portions) of the front and rear side plates 55*b* and 55*c*, and penetrates the rear side plate 55*c* rearward. The feed roller 45 is fixed to the driving shaft 59 between the front and rear side plates 55*b* and 55*c* in a rotatable manner together with the driving shaft 59.

The pickup roller 43 is supported by a rotational shaft 61 provided between the other end portions (the left end portions) of the front and rear side plates 55*b* and 55*c* in a rotatable manner. On the inner face of the front side plate 55*b*, an idle gear 63 meshed with the pickup roller 43 and the feed roller 45 are supported in a rotatable manner. Thereby, when the feed roller 45 is rotated together with the driving shaft 59, the pickup roller 43 is rotated in the same rotational direction as the feed roller 45 via the idle gear 63.

The sheet feed holder 55 is provided with a push-down piece 65 and a light shielding piece 67. As shown in FIG. 7, the push-down piece 65 protrudes outward (leftward) from the other end portion (the left end portion, the turning side end portion) of the top plate 55*a*. As shown in FIG. 6, the light shielding piece 67 protrudes outward (rearward) from the rear side plate 55*c*.

As shown in FIG. 4, the driving shaft 59 of the sheet feeding holder 55 is supported by the housing 41 such that the turning side end portion (the left end portion) of the sheet feeding holder 55 is exposed through the opening 51 of the bottom plate 41*a* of the housing 41. As shown in FIG. 3, the rear end portion of the driving shaft 59 penetrates the rear side plate 41*c* of the housing 41 and protrudes rearward. To the rear end portion protruded from the rear side plate 41*c*, an input coupling 59*a* is fixed, which is connected to a driving source (not shown) provided in the apparatus main body 3. The driving shaft 59 is supported to the bottom plate 41*a* of the housing 41 by two supporting members 68.

When the sheet feeding holder 55 is supported in the above manner, the pickup roller 43 supported to the turning side end portion of the sheet feeding holder 55 is exposed downward through the opening 51. As described later, the sheet feeding holder 55 is pushed up by the sheet placed on the sheet placement plate 14 (refer to FIG. 1) and turned to a suitable pickup position. A contact point between the pickup roller 43 and the sheet in the pickup position is defined as a first contact point P1.

The bottom plate 41*a* of the housing 41 is provided with an upper face detection sensor 69 (refer to FIG. 3) on a rear side of the opening 51. The upper face detection sensor 69 is an optical sensor having a light emitting part emitting light and a light receiving part receiving the emitted light. The upper face detection sensor 69 is disposed such that the light spieling piece 67 passes between the light emitting part and the light receiving part when the sheet feeding holder 55 is turned. When the light emitted from the light emitting part is received by the light receiving part, the upper face detection sensor 69 outputs an OFF signal, and when the light emitted from the light emitting part is shielded by the light shielding piece 67 and is not received by the light receiving part, the upper face detection sensor 69 outputs an ON signal.

Additionally, the sheet feeding device 37 further includes a pressing force adjustment mechanism 71 which presses the pickup roller 43 on the sheet and adjusts the pressing force of the pickup roller 43 on the sheet. The pressing force adjustment mechanism 71 will be described with reference to FIG. 3 and FIG. 5 to FIG. 7. The pressing force adjustment mechanism 71 includes an arm member 73, a link member 75 and a pressing member 77.

As shown in FIG. 3, the arm member 73 is a rod-like member having a rectangular cross section and a length of about a half of the bottom plate 41*a* in the width direction. As shown in FIG. 6, at one end portion (the rear end portion) of the arm member 73, a guide part 79 is formed, which has a parallelepiped hollow portion long in the width direction. The guide part 79 has an inner side wall 79*a* and an outer side wall 79*b* which face each other in the width direction. Each of the side walls 79*a* and 79*b* has a recess 83 cut out downward from the upper edge. As shown in FIG. 5, at the other end portion (the front end portion) of the arm member 73, a rack gear 81 is formed in the width direction.

As shown in FIG. 3, the arm member 73 is supported on the bottom plate 41*a* of the housing 41 on a front side of the opening 51 and reciprocates in the width direction. On the bottom plate 41*a*, a first gear 85 meshed with the rack gear 81 and a second gear 87 meshed with the first gear 85 are supported in a rotatable manner. The outer circumference of the second gear 87 is exposed through an opening of the front side plate 41*b* of the housing 41. By rotating the second gear 87, the arm member 73 reciprocates in the width direction via the first gear 85. The second gear 87 is so provided as to be temporarily fixed at a predetermined position by a rachet mechanism and a biasing member (the both are not shown).

As shown in FIG. 6, the link member 75 is a rod-like member having a circular cross section. In the approximately longitudinal center portion of the link member 75, an annular lock part 89 is formed. In the link member 75, the lock part 89 is stored in the guide part 79 of the arm member 73, and the portions on both inner and outer sides of the lock part 89 are supported in the recesses 83 of both the side wall 79*a* and 79*b*. A coil spring 91 is disposed around the link member 75 on the inner side of the lock part 89. One end of the coil spring 91 is locked to the lock part 89 and the other end of the coil spring 91 is locked to the inner side wall 79*a* of the guide part 79. The coil spring 91 biases the link member 75 inward (rearward) with respect to the arm member 73.

As shown in FIG. 6 and FIG. 7, the pressing member 77 is a member having a right angled triangle shape, when viewed along the left-and-right direction, and has a bearing part 93, a pressed part 95 and a pressing part 97. The baring part 93 is provided on the apex portion of the pressing member 77. The pressed part 95 is provided on one side face extending radially from the bearing part 93. The pressing part 97 is provided on the other side face extending radially from the bearing part 93. The bearing part 93 is supported by a rotational shaft of the housing 41, in which the rotational shaft is formed along a direction (the left-and-right direction) perpendicular to the width direction. Then, the pressing member 77 is turnable around the rotational shaft. As shown in FIG. 6, with the pressed part 95, the inner end face of the link member 75 comes into contact, and as shown in FIG. 7, the pressing part 97 faces the push-down piece 65 of the sheet feeding holder 55 from the upper side.

A process to adjust the pressing force of the pickup roller 43 by the pressing force adjustment mechanism 71 will be described. When the second gear 87 is rotated in the counterclockwise direction in FIG. 5, the arm member 73 is moved inward (rearward) via the first gear 85. Then, the inner end face of the link member 75 comes into contact with the pressed part 95 of the pressing member 77, and the pressing member 77 is turned around the rotational shaft. When the arm member 73 is further moved inward, the coil spring 91 is stretched. Then, the compressing force of the coil spring 91 is transmitted to the link member 75, and a force for the link member 75 to press the pressed part 95 is increased. Then, the pressing member 77 is further rotated to increase a force for the pressing part 97 to push down the push-down piece 65. As a result, the sheet feeding holder 55 is applied with the pressing force by the pressing member 77, in addition to its gravity, to increase the force for the pickup roller 43 press the sheet.

On the other hand, when the second gear 87 is rotated in the clockwise direction, the arm member 73 is moved outward via the first gear 85. Then, the stretching length of the coil spring 91 is decreased, and the compressing force of the coil sprig 91 is decreased. As a result, the force for turning the pressing member 77 is decreased, and the force for the pressing part 97 to push down the push-down piece 65 of the sheet feeding holder 55 is also decreased. In the above described manner, it becomes possible to adjust the pressing force of the pickup roller 43.

Figure 8:
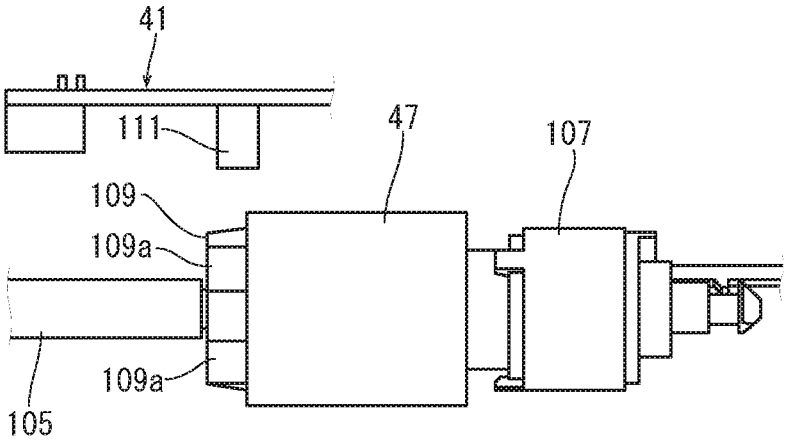
FIG. 8 is a side view showing a retard roller, in the sheet feeding device according to the embodiment of the present disclosure.
Figure 9:
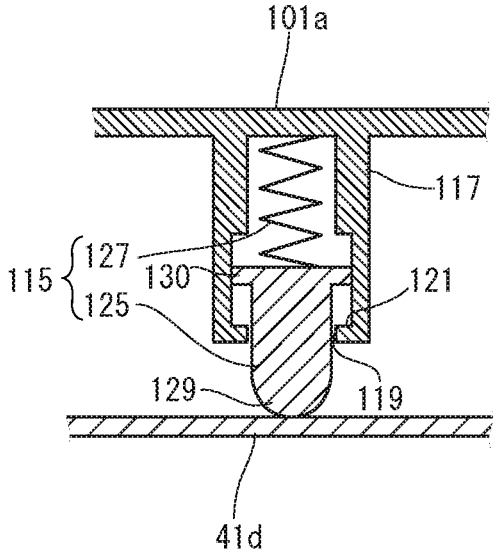
FIG. 9 is a side view showing a biasing member of the retard roller, in the sheet feeding device according to the embodiment of the present disclosure.

Next, the retard roller 47 will be described with reference to FIG. 4, and FIG. 8 to FIG. 9. FIG. 8 is a side view showing the retard roller and FIG. 9 is a sectional view showing a spring storage part.

The retard roller 47 is supported by a retard holder 101. The retard holder 101 is an approximately parallelepiped box-like member whose upper face is opened, and has a bottom plate 101*a* and a front and a rear side plates 101*b* which face each other in the width direction. In the one end portions (the right end portions) of the front and rear side plates 101*b*, axial holes 103 are formed coaxially. Between the other end portions (the left end portions) of the front and rear side pales 101*b*, a rotational shaft 105 is provided.

As shown in FIG. 8, the retard roller 47 is supported by the rotational shaft 105 via a torque limiter 107 in the rotatable manner. The retard roller 47 is provided with a pulse plate 109 rotating together with the retard roller 47. The pulse plate 109 is an annular member, and reflection plates 109*a* are fixed around the outer circumference at predetermined intervals. On the other hand, the housing 41 is provided with a rotation detection sensor 111. The rotation detection sensor 111 is an optical sensor having a light emitting part emitting light toward the pulse plate 109 and a light receiving part receiving the light reflected by the pulse plates 109. When the light emitted from the light emitting part is emitted to the reflection plate 109*a* of the pulse plate 109, the light is reflected by the reflection plate 109*a* and received by the light receiving part. On the other hand, when the light emitted from the light emitting part is emitted to the portion other than the reflection plate 109*a* of the pulse plate 109, the light is not reflected and not received by the light receiving part. When the light emitted from the light emitting part is received by the light receiving part, the rotation detection sensor 111 outputs an ON signal, and when the light emitted from the light emitting part is not received by the receiving part, the rotation detection sensor 111 outputs an OFF signal.

The retard holder 101 has a spring storage part 117 in which a biasing member 115 for pressing the retard roller 47 on the feed roller 45 is stored. The spring storage part 117 will be described with reference to FIG. 9. The spring storage part 117 has a cylindrical shape, and protrudes downward from the turning side end portion of the bottom plate 101*a* of the retard holder 101. In the lower end wall of the spring storage part 17, an opening 119 is formed. On the lower half portion of the inner circumferential wall of the spring storage part 117, a large diameter guide groove 121 is formed.

The biasing member 115 has a protruding member 125 and a coil spring 127. The protruding member 125 has an approximately columnar shape, and has a semicircular lower end contact portion 129. At the upper end portion of the protruding member 125, a flange 130 protruding outward is formed. The protruding member 125 is stored in the spring storage part 117 such that the contact portion 129 protrudes outward through the opening 119 of the spring storage part 117 and the flange 130 is engaged with the guide groove 121 of the spring storage part 117. The coil spring 127 is disposed between the bottom plate 101*a* and the flange 130 of the protruding member 125. The coil spring 127 biases the protruding member 125 downward.

The retard holder 101 faces the feed roller 45 and the conveyance rollers pair 49, and is disposed such that the retard roller 47 presses the feed roller 45 from the lower side, and a pin 131 of the bottom plate 41*a* of the housing 41 is inserted into the axial holes 103. Thus, the retard holder 101 is pivoted around the pin 131 as a pivot fulcrum in directions in which the retard roller 47 is closer to and separate away the feed roller 45. Additionally, the contact portion 129 of the protruding member 125 comes into contact with a supporting plate 41*d* of the bottom plate 41*a*. Then, the coil spring 127 is compressed to bias the retard holder 101 upward with respect to the supporting plate 41*d*. That is, the retard holder 101 is pivoted in the direction in which the retard roller 47 is closer to the feed roller 45, the retard roller 47 comes into contact with the feed roller 45 at a second contact point P2 with a suitable pressure, and a separation nip is formed between both the rollers 47 and 45 (refer to FIG. 4). By removing the axal hole 103 from the pin 131, the retard holder 101 can be detached from the housing 41. As described above, because the retard roller 47 and the feed roller 45 come into contact with each other with a suitable pressure, both the rollers 47 and 45 are elastically deformed slightly. Then, the separation nip has a predetermined length along the circumferential directions. The second contact point P2 shows a center of the separation nip in the circumferential direction.

As shown in FIG. 4, the retard roller 47 is pressed on the feed roller 45 along a direction of the normal line L1 of the outer circumferential surface of the retard roller 47 at the second contact point P2 (the line passing through the axial centers of the feed roller 45 and the retard roller 47). That is, the pin 131 is positioned such that the pivot direction of the retard holder 101 at second contact point p2 coincides with the direction of the normal line L1 of the outer circumferential surface of the retard roller 47 at the second contact point P2.

Next, the conveyance rollers pair 49 will be described with reference to FIG. 4. The conveyance rollers pair 49 contains an upper roller 141 driven by a driving source to be rotated and a lower roller 143 driven by the upper roller 141 to be rotated. Each roller has the same width as the feed roller 45. The upper and lower rollers 141 and 143 comes into contact with each other at a third contact point P3 on a line passing through the axial centers of the rotational shaft 145 of the upper roller 141 and the rotational shaft 146 of the lower roller 143. Between the upper and lower rollers 141 and 143, a conveyance nip is formed. As with the separation nip, because the upper and lower rollers 141 and 143 come into contact with each other with a suitable pressure, both the rollers 141 and 145 are elastically deformed slightly. Then, the conveyance nip has a predetermined length along the circumferential directions. The third contact point P3 shows a center of the conveyance nip in the circumferential direction. As shown in FIG. 3, both the end portions of the rotational shaft 145 of the upper roller 141 are supported by both the side plates 41*b* and 41*c* of the housing 41. The rear end portion of the rotational shaft 145 penetrates the rear side plate 41*c*, and protrudes rearward. To the rear end portion protruding from the rear side plate 41*c*, an input coupling 145*a* is fixed. The input coupling 145*a* is connected to a driving source (not shown) provided in the apparatus main body 3.

As shown in FIG. 4, the pin 131 to which the retard holder 101 is supported is disposed on the downstream side of the conveyance nip between both the rollers 141 and 143 of the conveyance rollers pair 49 in the conveyance direction, and the retard holder 101 does not interfere with the conveyance rollers pair 49.

Here, the first contact point P1 between the pickup roller 43 and the sheet S at the pickup position, the third contact point P3 between the upper and lower rollers 141 and 143 of the conveyance rollers pair 49 and the second contact point P2 between the feed roller 45 and the retard roller 47 are disposed on a line L2 along the conveyance direction, when viewed from the axial direction their rotational shafts. As described above, the third contact point P3 between the upper and lower rollers 141 and 143 of the conveyance rollers pair 49 is disposed on the line passing the axial centers of the rotational shafts 145 and 146 of the upper and the lower rollers 141 and 143. Then, a linear sheet feeding path 151 is formed from the first contact point P1 between the pickup roller 43 and the sheet S at the pickup position through the separation nip to the conveyance nip. Furthermore, when a sheet feeding pressure applied to the sheet S from the pickup roller 43 at the first contact point P1 is set to F1, the separation pressure at the second contact point P2 is set to F2 and the conveyance pressure at the third contact point P3 is set to F3, the following equation is satisfied, $F1 \leq F2 < F3$. The separation pressure at the second contact point is a pressure after subtracting a braking force of the retard roller 47. The braking force is a force applied by the torque limiter 107 in a direction opposite to the feeding direction.

With reference to FIG. 2 again, the left sheet feeding device 37 is supported by the lower guide plate 35 such that the conveyance direction is along an oblique right upper direction, and the sheet feeding path 151 is connected to the horizontal conveyance path 31. The right sheet feeding device 37 is supported by the lower guide plate 35 such that the conveyance direction is along an oblique right upper direction, and the sheet feeding path 151 is connected to the conveyance path 11.

Figure 10:
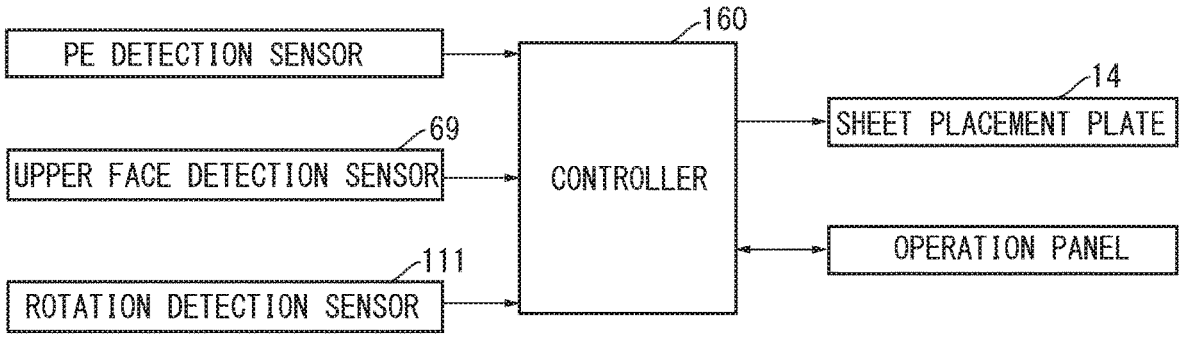
FIG. 10 is a block diagram of a controller of the image forming apparatus according to the embodiment of the present disclosure.

Next, the controller 160 will be described with reference to the block diagram shown in FIG. 10. The controller 160 are electrically connected to the PE sensor, the upper face detection sensor 69, the rotation detection sensor 111, an operation panel (not shown) provided in the apparatus main body 3 and the sheet placement plate 14 (the lifting mechanism).

To the controller 160, the ON signal and the OFF signal are input from the PE detection sensor. The PE detection sensor detects that the actuator provided on the bottom plate 41*a* of the housing 41 in the turnable manner is turned from the predetermined posture, as described above. When the sheet placement plate 14 is lifted by the lifting mechanism, the actuator is pushed up by the sheet placed on the sheet placement plate 14 to turn the actuator into the predetermined posture. Then, the PE detection sensor outputs the OFF signal. When the amount of the sheets on the sheet placement plate 14 is decreased during the image forming operation, because the sheet placement plate 14 is lifted by the decreased amount, the posture of the actuator is thus kept constant and the PE detection sensor outputs the OFF signal. However, when there is no sheet on the sheet placement plate 14, the actuator passes through the slit of the sheet placement plate 14 to be turned from the predetermined posture. Then, the PE detection sensor outputs the ON signal.

When input the ON signal from the PE detection sensor, the controller 160 determines that there is no sheet on the sheet placement plate 14. Then, the controller 160 displays the absence of the sheet, on the operation panel.

To the controller 160, the ON signal and the OFF signal are input from the upper face detection sensor 69. When the sheet placement plate 14 is lifted, the uppermost sheet of the sheets placed on the sheet placement plate 14 comes into contact with the pickup roller 43 of the sheet feeding device 37, and the pickup roller 43 is pushed up by the sheets. Then, the sheet feeding holder 55 is rocked upward around the driving shaft 59. When the sheet feeding holder 55 is rocked upward and the light shielding piece 67 of the sheet feeding holder 55 passes between the light emitting part and the light receiving part of the upper face detection sensor 69, the light emitted by the light emitting part is shielded by the light shielding piece 67 and is not received by the light receiving part. Then, the upper face detection sensor 69 outputs the ON signal.

When input the ON signal, the controller 160 determines that the pickup roller 43 reaches the pickup position, and controls the lifting mechanism of the sheet placement plate 14 to stop the lifting of the sheet placement plate 14. Then, the pickup roller 43 is always kept at the pickup position.

To the controller 160, the ON signal and the OFF signal are input from the rotation detection sensor 111. When the ON signals are input at predetermined time intervals, the controller 160 determines that the pulse plate 109, that is, the retard roller 47 rotates normally. On the other hand, when the time interval of the ON signals is shifted from a predetermined time interval, the controller 160 determines that the retard roller 47 rotates abnormally, and displays that maintenance of the retard roller 47 is required, on the operation panel.

The sheet feeding operation of the sheet feeding device 37 from the large capacity cassette 13L1 (the upstream side cassette) having the above described configuration will be described. When the sheet feeding operation is started, the lifting mechanism of the sheet placement plate 14 is driven to lift the sheet placement plate 14 of the large capacity cassette 13L1. Then, the uppermost sheet of the first sheets placed on the sheet placement plate 14 comes into contact with the pickup roller 43 of the sheet feeding device 37, and the pickup roller 43 is pushed up by the sheets. Then, the sheet feeding holder 55 is rocked upward around the driving shaft 59. When the light shielding piece 67 of the sheet feeding holder 55 passes between the light emitting part and the light receiving part of the upper detection sensor 69 and the ON signal output from the upper face detection sensor 69 is input to the controller 160, the controller 160 drives the lifting mechanism to stop the lifting of the sheet placement plate 14. Then, the pickup roller 43 reaches the pickup position.

After that, the driving shaft 59 of the feed roller 45 and the rotational shaft 145 of the upper roller 141 of the conveyance rollers pair 49 are driven to be rotated. When the driving shaft 59 of the feed roller 45 is rotated, the pickup roller 43 is rotated together with the feed roller 45. Then, the uppermost sheet is conveyed along the sheet feeding path 151 toward the separation nip.

When one of the sheets is conveyed, the retard roller 47 is driven by the feed roller 45 to be rotated at the separation nip to convey the sheet toward the conveyance nip. On the other hand, when two or more of the sheets are conveyed, although the uppermost sheet is conveyed by the feed roller 45, because a friction force between the uppermost sheet and the lower sheet is smaller than a friction force between the lower sheet and the retard roller 47, the retard roller 47 is not applied with a torque larger than a predetermined value and is not rotated owing to the action of the torque limiter 107, and the lower sheet is not conveyed. In the above manner, the sheets are separated by the feed roller 45 and the retard roller 47, and only the uppermost sheet is conveyed toward the conveyance nip.

When the rotational shaft 145 of the upper roller 141 of the conveyance rollers pair 49 is rotated, the sheet conveyed toward the conveyance nip is passed through the conveyance nip, and then conveyed from the sheet feeding path 151 to the horizontal conveyance path 31. Then, the sheet is conveyed along the horizontal conveyance path 31 by the two sets of the conveyance rollers pair 39 and then to the conveyance path 11 through the inclined path 38.

Figure 11:
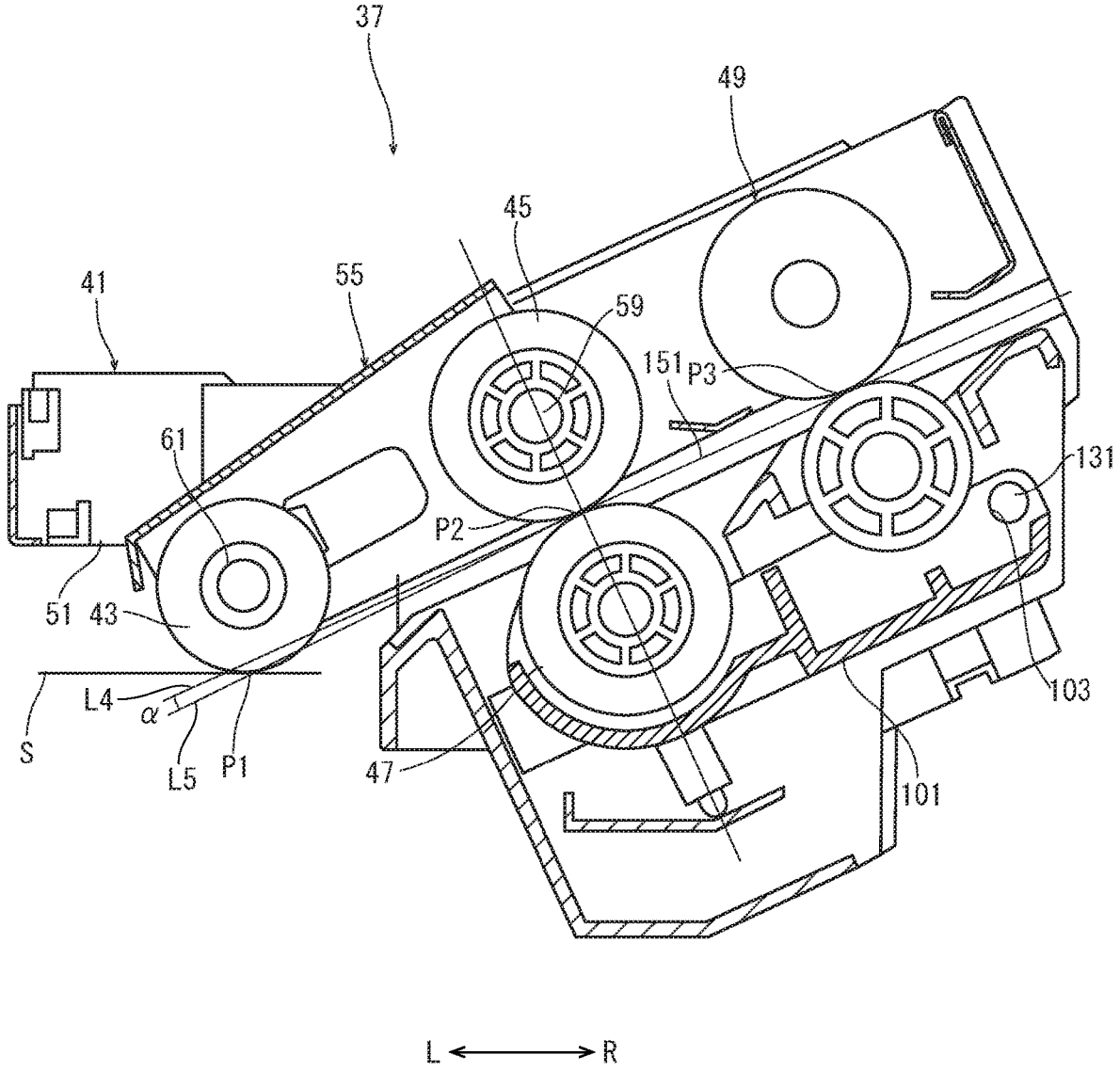
FIG. 11 is a sectional view showing the sheet feeding device (in a state where the pickup roller is turned downward from the pickup position) according to the embodiment of the present disclosure.

When an amount of the sheets placed on the sheet placement plate 14 is decreased during the image forming operation, the contact position between the pickup roller 43 and the uppermost sheet is lowered and the sheet feeding holder 55 is rocked downward around the driving shaft 59. At this time, as shown in FIG. 11, when an angle $\alpha$ of the line L5 passing through the first contact point P1 and the second contact point P2, with respect to the line L4 passing through the second contact point P2 and the third contact point P3 is about 5 degrees, the pickup roller 43 can convey the sheet smoothly. Then, when the angle $\alpha$ of the line L5 with respect to the line L4 is larger than or equal to 5 degrees, the upper face detection sensor 69 is preferably set to output the ON signal.

When there is no sheet placed on the sheet placement plate 14, as described above, the actuator passes through the slit of the sheet placement plate 14 to be turned from the predetermined posture, and the PE detection sensor outputs the ON signal. When the ON signal is input, the controller 160 determines the absence of the sheet on the sheet placement plate 14, and then displays the absence of the sheet, on the operation panel. When the second sheet is fed from the large capacity cassette 13L2 (the downstream side cassette), the sheet is conveyed through the feeding path 151 to the conveyance path 11.

As described above, according to the present disclosure, the sheet is conveyed along the linear sheet feeding path 151 passing through the first contact point P1 between the pickup roller 43 and the uppermost sheet at the pickup position, the second contact point P2 between the feed roller 45 and the retard roller 47 and the third contact point P3 between the upper and lower rollers 141 and 143 of the conveyance rollers pair 49, in which the third contact point P3 between the upper and lower rollers 141 and 143 is disposed on a linear line passing through the axial centers of the rotational shafts 145 and 146 of the upper and the lower rollers 141 and 143. Thereby, the retard roller 47 or the feed roller 45 is hardly applied with a load from the sheet nipped at the separation nip and the conveyance nip. That is, a friction between the feed roller 45 or the retard roller 47 and the sheet hardly occurs so that the feed roller 45 or the retard roller 47 hardly wear. Accordingly, a separation failure at the separation nip hardly occur, and it becomes possible to prolong the life of the retard roller 47 and the feed roller 45.

Additionally, the first contact point P1, the second contact point P2 and the third contact point P3 are aligned on a linear line, and furthermore, the sheet feeding pressure F1 at the first contact point P1, the separation pressure F2 at the second contact point P2 and the conveyance pressure F3 at the third contact point P3*p* are set as follows: $F1 \leq F2 < F3$. By increasing the conveyance pressure, the conveyance of the sheet conveyed by the pickup roller 43 is assisted, and it becomes possible to decrease the separation pressure by the amount of the increased conveyance pressure. Accordingly, it becomes possible to decrease the separation pressure and to increase the separation force.

Especially, because the conveyance rollers pair 49, the pickup roller 43, the feed roller 45 and the retard roller 47 are integrated into one unit, the positioning accuracy of the conveyance nip with respect to the first contact point P1 between the pickup roller 43 and the uppermost sheet and the separation nip is easily increased. Additionally, the adjustment and the management of all the rollers can be performed totally so that the maintenance performance can be improved. Accordingly, it becomes possible to improve the durability for all kinds of the sheet and to keep the initial image quality. However, the conveyance rollers pair 49 may be provided in the upper and lower guide plates 33 and 35 so as to be positioned on a line passing through the first contact point P1 between the pickup roller 43 and the uppermost sheet at the pickup position and the second contact point P2.

Additionally, the retard roller 47 is pressed on the feed roller 45 along a direction of the normal line L1 of the outer circumferential surface of the retard roller 47 at the second contact point P2. Accordingly, it becomes possible to convey the sheet passed through the separation nip along the sheet feeding path 151 stably. That is, because the pin 131 to which the retard holder 101 is supported is disposed on the downstream side of the conveyance nip of the conveyance rollers pair 49 in the conveyance direction, it becomes possible to coincide the pivot direction of the retard holder 101 at the second contact point P2 with the direction of the normal line L1 of the outer circumferential surface of the retard roller 47 at the second contact point P2. In addition, a setting range of the separation pressure of the separation nip can be widened so as to correspond to the sheets having different thicknesses and properties. The conveyance force (the separation pressure F2) is a tradeoff with the separation force, and as the separation force is increased, the conveyance force is decreased. As described above, in the present embodiment, by increasing the conveyance pressure F3, the conveyance of the sheet is assisted to compensate the decrease of the conveyance force at the separation nip. Accordingly, it becomes possible to increase the separation force more than before and to widen the setting range of the separation pressure.

The sheet feeding device 37 is supported by the horizontal sheet feeding mechanism 15L which is detachable from the apparatus main body 3. Accordingly, by detaching the horizontal conveyance device from the apparatus main body 3, the maintenance and the replacement of the rollers can be easily performed. Additionally, because the retard holder 101 is detachable from the housing 41 of the sheet feeding device 37, the maintenance and the replacement of the retard roller 47 and the other rollers can be easily performed.

The pressing force adjustment mechanism 71 can adjust the pressing force of the pickup roller 43 with multiple steps so that the pressing force can be set suitably depending on the thickness and the kinds of the sheet.

Although the present disclosure described the specific embodiment, the present disclosure is not limited to the embodiment. It is to be noted that one skilled in the art can modify the embodiment without departing from the scope and spirit of the present disclosure.

The invention claimed is:

1. A sheet feeding device comprising:

a pickup roller that contacts a sheet at a first contact point in a pickup position and rotates to convey the sheet in a predetermined conveyance direction;

a feed roller disposed on a downstream side of the pickup roller in the conveyance direction;

a retard roller that contacts the feed roller at a second contact point and conveys the sheet while separating the sheet; and a conveyance rollers pair that contacts each other at a third contact point and conveys the sheet passing through the second contact point to a conveyance path, wherein the first contact point, the second contact point and the third contact point are disposed on a linear line in the conveyance direction, when viewed from axial directions of the rollers, wherein when a sheet feeding pressure applied to the sheet from the pickup roller at the first contact point is set to F1, a separation pressure at the second contact point is set to F2 and a conveyance pressure at the third contact point is set to F3, the following equation is satisfied:

$$F1 \leq F2 < F3.$$

2. The sheet feeding device according to claim 1, further comprising a retard holder supporting the retard roller in a rotatable manner, wherein the retard holder is provided so as to pivot around a pivot fulcrum disposed on a downstream side of the third contact point in the conveyance direction.

3. The sheet feeding device according to claim 2, further comprising a biasing member which is disposed below the retard holder and biases the retard holder such that the retard roller is pressed on the feed roller along a direction of a normal line of an outer circumferential surface of the retard roller at the second contact point.

4. An image forming apparatus comprising:

an apparatus main body in which the conveyance path is formed;

an upstream side cassette disposed below an image forming part and accommodating a first sheet;

a downstream side cassette disposed on a downstream side in a horizontal conveyance direction of the upstream side cassette side by side, the downstream side cassette accommodating a second sheet;

the image forming part disposed on the conveyance path and forming an image on the first sheet and the second sheet; and a horizontal sheet feeding mechanism conveying the first sheet from the upstream side cassette and the second sheet from the downstream side cassette to the conveyance path;

wherein the horizontal sheet feeding mechanism includes:

a horizontal conveyance path disposed above the upstream side cassette and the downstream side cassette and connecting to the conveyance path, the first sheet accommodated in the upstream side cassette being conveyed along the horizontal conveyance path; and two of the sheet feeding devices according to claim 1, wherein one of the two sheet feeding devices conveys the first sheet from the upstream side cassette to the horizontal conveyance path; and the other two of the sheet feeding devices conveys the second sheet from the downstream side cassette to the conveyance path.

5. The image forming apparatus according to claim 4, wherein the horizontal sheet feeding mechanism is drawable from the apparatus main body along a horizontal direction perpendicular to the conveyance direction.

* * * * *